US010272633B2

(12) United States Patent
Bayer et al.

(10) Patent No.: US 10,272,633 B2
(45) Date of Patent: Apr. 30, 2019

(54) CORRUGATED BOARD MACHINE

(71) Applicant: BHS Corrugated Maschinen-und Anlagenbau GmbH, Weiherhammer (DE)

(72) Inventors: Friedrich Bayer, Hirschau (DE); Helmut Kraus, Wackersdorf (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 114 days.

(21) Appl. No.: 15/272,985

(22) Filed: Sep. 22, 2016

(65) Prior Publication Data

US 2017/0087794 A1 Mar. 30, 2017

(30) Foreign Application Priority Data

Sep. 24, 2015 (DE) ..... 10 2015 218 318
Oct. 9, 2015 (DE) ..... 10 2015 219 630

(51) Int. Cl.

| | |
|---|---|
| ***B31F 1/28*** | (2006.01) |
| ***B26D 5/00*** | (2006.01) |
| ***B26D 5/34*** | (2006.01) |
| *B31B 50/14* | (2017.01) |
| *B31B 50/88* | (2017.01) |
| *B31B 50/98* | (2017.01) |

(52) U.S. Cl.

CPC ..... *B31F 1/2831* (2013.01); *B26D 5/007* (2013.01); *B26D 5/34* (2013.01); *B31F 1/2822* (2013.01); *B31B 50/14* (2017.08); *B31B 50/88* (2017.08); *B31B 50/98* (2017.08)

(58) Field of Classification Search

CPC ..... B32B 29/08; B32B 2317/127; B31F 1/22; B31F 1/24; B31F 1/28; B31F 1/2822; B31F 1/2831; B31F 1/2836; B31B 50/88
USPC ..... 156/64, 350, 351, 361, 462
See application file for complete search history.

(56) References Cited

U.S. PATENT DOCUMENTS 4,380,943 A 4/1983 Evans
4,576,663 A 3/1986 Bory
(Continued)

FOREIGN PATENT DOCUMENTS

DE 32 17 703 A1 12/1982
DE 41 22 600 A1 1/1992
(Continued)

*Primary Examiner* — George R Koch
(74) *Attorney, Agent, or Firm* — McGlew and Tuttle, P.C.

(57) ABSTRACT

The invention relates to a corrugated board machine for producing corrugated board. The corrugated board machine comprises a detecting arrangement for detecting at least one web of corrugated board web, an order change cutting device arranged downstream of the detecting arrangement and an information processing device, which is in signal connection with the detecting arrangement. Furthermore, the corrugated board machine has a control device, which is in signal connection with the information processing device, with which the order change cutting device is in signal connection and as a function of a change identified by the information processing device of a first printing area printed on the web of corrugated board web to a second printing area printed onto the web of corrugated board web activates the order change cutting device to perform an order change on the corrugated board web.

20 Claims, 5 Drawing Sheets

(56) References Cited

U.S. PATENT DOCUMENTS

| | | | | |
|---|---|---|---|---|
| 5,325,306 | A | 6/1994 | Adachi et al. | |
| 5,632,850 | A | 5/1997 | Knorr et al. | |
| 6,071,222 | A * | 6/2000 | Schneider | B26D 1/245 493/355 |
| 2004/0182503 | A1* | 9/2004 | Stadele | B31F 1/2822 156/210 |
| 2014/0000785 | A1* | 1/2014 | Gnan | B31F 1/20 156/64 |

FOREIGN PATENT DOCUMENTS

| | | | |
|---|---|---|---|
| DE | 197 54 799 | A1 | 6/1999 |
| DE | 101 31 833 | A1 | 1/2003 |
| DE | 103 12 600 | A1 | 10/2004 |
| DE | 103 31 357 | A1 | 1/2005 |
| DE | 10 2004 003 560 | A1 | 8/2005 |
| EP | 0 687 552 | A2 | 12/1995 |
| EP | 1 459 878 | A2 | 9/2004 |
| EP | 1 652 806 | A1 | 5/2006 |
| GB | 1 468 013 | A | 3/1977 |
| GB | 2 282 464 | A | 4/1995 |
| WO | 2010/103441 | A1 | 9/2010 |

* cited by examiner

CORRUGATED BOARD MACHINE

CROSS-REFERENCES TO RELATED APPLICATIONS

This application claims the priority of German Patent Application Serial No. DE 10 2015 218 318.1, filed on Sep. 24, 2015, and DE 10 2015 219 630.5, filed on Oct. 9, 2015, pursuant to 35 U.S.C. 119(a)-(d), the content of which is incorporated herein in its entirety as if fully set forth herein.

FIELD OF THE APPLICATION

The invention relates to a corrugated board machine for producing corrugated board.

BACKGROUND OF THE INVENTION

Corrugated board machines are known in general from the prior art. The latter have proved effective in practice.

SUMMARY OF THE INVENTION

The underlying objective of the invention is to provide a corrugated board machine which is highly economical. In particular, the latter should also be particularly user-friendly.

Said objective is achieved according to the invention by a corrugated board machine for producing corrugated board, comprising a detecting arrangement for detecting at least one printed web of a corrugated board web, an order change cutting device arranged downstream of the detecting arrangement, an information processing device, which is in signal connection with the detecting arrangement, and a control device, which is in signal connection with the information processing device, is in signal connection with the order change cutting device, and as a function of a change recognised by the information processing device of a first printing area printed onto the web of the corrugated board web to a second printing area printed onto the web of the corrugated board web activates the order change cutting device for bringing about an order change on the corrugated board web. The central feature of the invention is that with changing printing areas on at least one of the webs of the corrugated board web the order change cutting device for the order change or format change is activated automatically. An order change is defined here in particular as a change to the cutting of the corrugated board web. The corrugated board web or its part-corrugated board webs can have a different width after the order change. Advantageously, faulty or excess material can be cut out of the corrugated board web by means of the order change cutting device.

It is an advantage, if at least one corrugated board web production arrangement is provided in order to produce at least one corrugated board web with at least two individual webs.

Advantageously, individual part-corrugated board webs are produced from the corrugated board web.

It is an advantage, if the corrugated board machine comprises at least one printing arrangement for printing at least one web of the corrugated board web. Alternatively, at least one printed web is inserted into the corrugated board machine.

It is advantageous if the information processing device is an electronic information processing device.

The signal connection between the information processing device and the detecting arrangement is for example wire-connected or wireless. The signal connection between the control device and the information processing device or the order change cutting device is preferably wire-connected or wireless.

It is advantageous if the information processing device and the control device are combined into one unit. Alternatively, the latter are designed to be separate from one another. For example the information processing device and the detecting arrangement are combined into one unit Alternatively, the latter are designed to be separate from one another.

The first and/or second printing area preferably comprises at least one imprint. The at least one imprint is formed in particular by ink, paint or the like. It is an advantage, if the imprint of the first and/or second printing area comprises at least one number, a letter, a photo, a graphic or the like. Preferably, the printing areas differ in size, arrangement on the web, form, colour, quality, text and/or motif or the like. The first and second printing area are preferably visible from the outside on the finished corrugated board web. The corrugated board web is preferably printed on one side or both sides.

The at least one web detected by the detecting arrangement can be for example a (raw) web for forming the corrugated board web. Alternatively, said detected web is already a fixed component of the corrugated board web.

The at least one detecting arrangement is designed for example as a camera arrangement, RFID detector arrangement, sensor arrangement or the like.

Preferably, the corrugated board web has at least two layers. In particular, it has three layers, five layers or seven layers.

The terms used here "arranged in front", "arranged behind", "downstream", "upstream" or the like refer preferably to the conveying direction of the respective web or the corrugated board web.

The configuration in which the detecting arrangement is an optically operating detecting arrangement allows contact-free detection of the web printed with printing areas. Damage to the detecting arrangement or to the respective detected web can thus be avoided easily and reliably.

In the configuration in which the information processing device identifies the change of the first printing area to the second printing area by means of image recognition and/or image comparison, the detecting arrangement is preferably arranged directly above the printing areas. Thus the printing areas are detected virtually directly. The change of the printing areas can be determined for example by comparing the printing areas, in particular by image comparison. For this purpose preferably at least one corresponding camera is used.

In the configuration in which the information processing device identifies the change from the first printing area to the second printing area by at least one change reference marking on the web of the corrugated board web or by an image comparison without change reference marking, which can be provided alternatively or in addition to the configuration in which the information processing device identifies the change of the first printing area to the second printing area by means of image recognition and/or image comparison, there is virtually an indirect recognition of the change of the printing areas over the at least one change reference marking. The at least one change reference marking is formed for example by at least one change reference imprint, at least one RFID element and/or at least one stamp or the like. The at least one change reference imprint can have any form, any pattern or the like. Preferably, the latter is formed by at least one geometric figure, such as a circle, a polygon, a straight line or the like. The at least one change reference marking is preferably assigned to the changing printing areas. For example, the at least one change reference marking is arranged between the changing printing areas or adjacent to the latter. Such a detecting arrangement can be designed to be extremely functionally secure and inexpensive.

The change in the printing areas can preferably be determined directly by the printing areas itself and/or indirectly by at least one change reference marking assigned to the change.

In one configuration, the change reference marking is provided in any position and/or laterally and/or centrally on the web. It can be arranged inside and/or outside a printing area on the web.

In one configuration, the detecting arrangement comprises a detecting unit which is arranged upstream of a gluing station for gluing and connecting at least one corrugated board web laminated on one side to at least one further material web. Preferably, the first detecting unit is arranged adjacent to the gluing station. Preferably, said detecting unit is assigned to the laminating web of the finished or subsequently corrugated board web. Alternatively, said detecting unit is assigned to an outer cover web of the finished or subsequent corrugated board web.

In one configuration the detecting arrangement comprises a detecting unit, which is arranged downstream of a gluing station for gluing and joining at least one corrugated board web laminated on one side to at least one further material web. Preferably, said detecting unit is arranged adjacent to the gluing station. It is an advantage, if said detecting unit of the laminating web is assigned to the finished or subsequent corrugated board web. Alternatively, said detecting unit is assigned to an outer cover web of the finished or subsequent corrugated board web.

In one configuration, the detecting arrangement comprises a detecting unit which is arranged downstream of a heating and pressing device and preferably also adjacent to the latter. Said detecting unit is preferably arranged upstream and in particular adjacent to the order change cutting device.

The cross-cutting device for at least partly cross-cutting the corrugated board web transversely to its conveying direction to bring about the order change produces for example in the corrugated board web on an order change at least one connecting cut of predefined length, which connects at least one first longitudinal cut and at least one second longitudinal cut offset laterally to the latter to change the width of the respective corrugated board web or partly corrugated board webs such that the latter remain/remains continuous. Preferably, the cross-cutting device is able to cut through the corrugated board web completely over its whole width, so that for example downstream longitudinal cutting means can be adjusted for longitudinally cutting the corrugated board web in the width direction of the corrugated board web. Preferably, the cross-cutting device is able to cut the corrugated board web completely over its whole width, so that faulty material can be removed for example.

The configuration in which the control device operates the at least one cross-cutting device such that the latter cuts into a change area between the printing areas makes it possible for the printing areas to remain undisturbed.

In one configuration, the detecting arrangement or the detecting unit is designed such as to detect in addition to detecting a change in a printing area also at least one remaining running marking on the printed web. The at least one remaining running marking supplies information for example on a previously printed web of corrugated board web (pre-print) about the remaining length or remaining meters of printed web of the corrugated board web or on a web of corrugated board printed in the corrugated board machine (inline printing) information about the remaining length of the current order.

In one configuration, the information processing device, particularly in the case of a subsequent change in quality, controls the upstream unrolling device of the web, in particular a splicing device, in order to start the next order in particular. The quality change is for example in form of a new kind of paper or material web roll.

In the following preferred embodiments of the invention are described by way of example with reference to the accompanying drawing.

DESCRIPTION OF THE PREFERRED EMBODIMENTS

Figure 1:
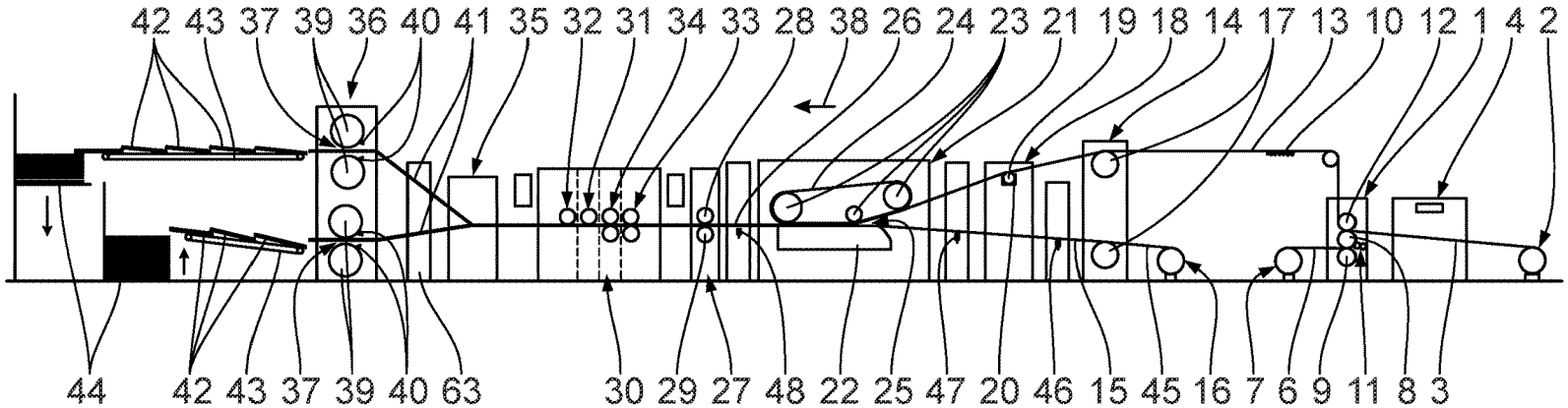
FIG. 1 shows a schematic side view of a corrugated board machine according to the invention.

A corrugated board machine, as shown schematically in FIG. 1, comprises a corrugated board production device 1 for producing corrugated board laminated on one side.

A first material web 3 of the corrugated board production device 1 is supplied by a first unrolling device 2. Preferably, the first unrolling device 2 is configured as a splicing device so that the first material web 3 is continuous.

Between the corrugated board production device 1 and the first unrolling device 2 a heating device 4 is arranged which heats the first material web 3.

The first material web 3 is combined in the corrugated board production device 1 with a second material web 6 which comes from a second unrolling device 7. The second unrolling device 7 is preferably designed as a splicing device so that the second material web 6 is continuous.

In the corrugated board production device 1 the second material web 6 is guided between two adjacent corrugating rollers 8, 9, so that the second material web 6 is corrugated or waved. After passing through the two corrugating rollers 8, 9 the second material web 6 is in the form of a corrugated web 10.

Afterwards the peaks of the corrugated web 10 are glued in the corrugated board production device 1 by means of a gluing device 11.

The corrugated web 10 provided with glue is then pressed in the corrugated board production device 1 together with the first material web 3 in a gap between a pressing device 12 and the upper corrugating roller 8 and joined together. The pressing device 12 is designed for example as a pressing roller. Alternatively, the latter comprises at least two deflection rollers and a pressing belt guided around the latter.

A corrugated board web 13 laminated on one side is guided out of the corrugated board production device 1 which web comprises the first material web 3 and the corrugated web 10. The corrugated board production device 1 is known for example from EP 0 687 552 A2 and U.S. Pat. No. 5,632,850, the details of which are referred to here.

The corrugated board web 13 laminated on one side is supplied to a preheating device 14.

Furthermore, a third material web 15 is supplied to the preheating device 14 from a third unrolling device 16. The third unrolling device 16 is preferably designed as a splicing device, so that the third material web 15 is continuous. The third material web 15 forms an outer laminating web on the finished corrugated board web.

The preheating device 14 has two heatable heating rollers 17 arranged above one another. The corrugated board web 13 laminated on one side and the third material web 15 partly encircle the respective heating roller 17 in the preheating device 14.

A gluing station 18 with a gluing roller 19 is arranged downstream of the preheating device 14, which partly dips into a glue bath 20. The corrugated web 10 of the corrugated board web 13 laminated on one side is in contact with the gluing roller 19, so that the corrugated web 10 is provided with glue there.

Downstream of the gluing station 18 a heating and pressing device 21 is arranged which comprises a horizontal table 22 with heating plates (not shown). Above the table 22 the heating and pressing device 21 has a continuous printing belt 24 driven guided about a roller 23. Between the printing belt 24 and the table 22 a pressing gap 25 is formed, by means of which the corrugated board web 13 laminated on one side and the third material web 15 are guided and are pressed against one another there. In the heating and pressing device 21 a three-layered corrugated board web 26 is formed.

Downstream of the heating and pressing device 21 a short cross-cutting device 27 is arranged. The short cross-cutting device 27 comprises a cutting cylinder 28 and a counter cylinder 29 arranged underneath the latter. The cutting cylinder 28 and the counter cylinder 29 are mounted rotatably, wherein their axes of rotation are parallel to one another and perpendicular to a conveying direction 38 of the corrugated board web 26. The cutting cylinder 28 and/or the counter cylinder 29 are in drive connection with at least one drive motor 60.

The cutting cylinder 28 has a cylinder casing, to which a blade (not shown) with a cutting edge is secured. The counter cylinder 29 also has a cylinder casing, to which a counter blade (not shown) with a cutting edge is secured.

On the cylinder casing of the counter cylinder 29 also a row of counter body elements (not shown) is arranged, which can be displaced between two radially projecting stops (not shown) fixed onto the cylinder casing extending over the width of the counter cylinder 29.

The short cross-cutting device 27 is able to make a cut which extends over the full width of the corrugated board web 26. For this purpose the cutting cylinder 28 and the counter cylinder 29 are set into rotation such that they interact with one another during the cutting process.

Furthermore, the short cross-cutting device 27 is able to produce a cut with a defined length and at a distance from an edge of the corrugated board web 26. For this purpose the counter body elements are selected or adjusted accordingly. For the cutting process the cutting cylinder 28 and the counter cylinder 29 are set into rotation such that the blade of the cutting cylinders 28 interacts with the counter body elements.

With regard to the detailed structure of the short cross-cutting device 27 and its function reference is made to DE 10 2004 003 560 A1. The short cross-cutting device 27 can also be designed to have a different construction.

Downstream of the short cross-cutting device 27 a longitudinal cutting edge/fluting device 30 is arranged. The longitudinal cutting edge/fluting device 30 has a first longitudinal cutting unit 31 and a second longitudinal cutting edge unit 32 arranged downstream of the latter. A first fluting unit 33 and a second fluting unit 34 are arranged upstream of the longitudinal cutting units 31, 32.

The longitudinal cutting units 31, 32 comprise tool beds (not shown), on which rotating blades (not shown) are provided on tool carriers (not shown) which are displaceable individually perpendicular to the conveying direction 38. The blades can be moved individually into engagement with the corrugated board web 26 and cooperate with rotary-driven not shown brush rollers arranged on the other side of the corrugated board web 26, when the blades are lowered into the corrugated board web 26.

The fluting units 33, 34 each comprise two tool beds (not shown), which are arranged above one another to be essentially mirror-symmetrical to the corrugated board web 26. On the pivotable tool beds fluting tools (not shown) arranged on tool carriers (not shown) are provided which are individually displaceable perpendicular to the conveying direction 38, which can be moved individually into engagement with the corrugated board web 26.

Reference is made to DE 197 54 799 A1 (corresponds to U.S. Pat. No. 6,071,222) and DE 101 31 833 A1 with regard to the detailed structure and the function of the longitudinal cutting/fluting device 30.

Alternatively, the short cross-cutting device 27 is arranged downstream of the longitudinal cutting edge/fluting device 30.

Downstream of the longitudinal cutting edge/fluting device 30 a switch 35 is provided for dividing part corrugated board webs 41 coming from the corrugated board web 26 into two planes. The partly corrugated board webs 41 are produced in the longitudinal cutting edge/fluting device 30.

Downstream of the switch 35 a cross-cutting device 36 is provided with two partly cross-cutting devices 37 arranged above one another. Each partly cross-cutting device 37 has two rotary driveable, transverse cutting rollers 39 arranged above one another and extending perpendicular to the conveying direction 38 of the corrugated board web 29, which each have a radially outwards extending cross-cutting blade 40 for completely cutting part corrugated board web 41 guided through the latter for producing corrugated board sheets 42.

Downstream of each part cross-cutting device 37 a conveyor belt 43 is arranged, on which the corrugated board sheets 42 are guided to a respective stack pile 44.

Upstream of the short cross-cutting device 27 a sensor arrangement is arranged which senses at least in some areas an outside 45 of the third material web 15. The sensor arrangement is arranged adjacent to the outside 45 of the third material web 15. The outside 45 forms an outside of the finished corrugated board web 26 or the finished part-corrugated board webs 41.

According to one embodiment the sensor arrangement comprises a (first) sensor 46, which is arranged between the preheating device 14 and the gluing station 18. The sensor 46 is directed to the outside 45 of the third material web 15.

The sensor arrangement has in addition to or as an alternative to the sensor 46 a (second) sensor 47, which is arranged between the gluing station 18 and heating and pressing device 21. The sensor 47 is directed to the outside 45 of the third material web 15.

The sensor arrangement has alternatively or in addition to the sensor 46 and/or 47 a (third) sensor 48, which is arranged between the short cross-cutting device 27 and the heating and pressing device 21.

The sensors 46 to 48 are preferably designed to be identical.

Between the switch 35 and the cross-cutting device 36 a registration mark device 63 is arranged for detecting registration marks on the corrugated board web 26 or on the part-corrugated board webs 41.

Figure 3:
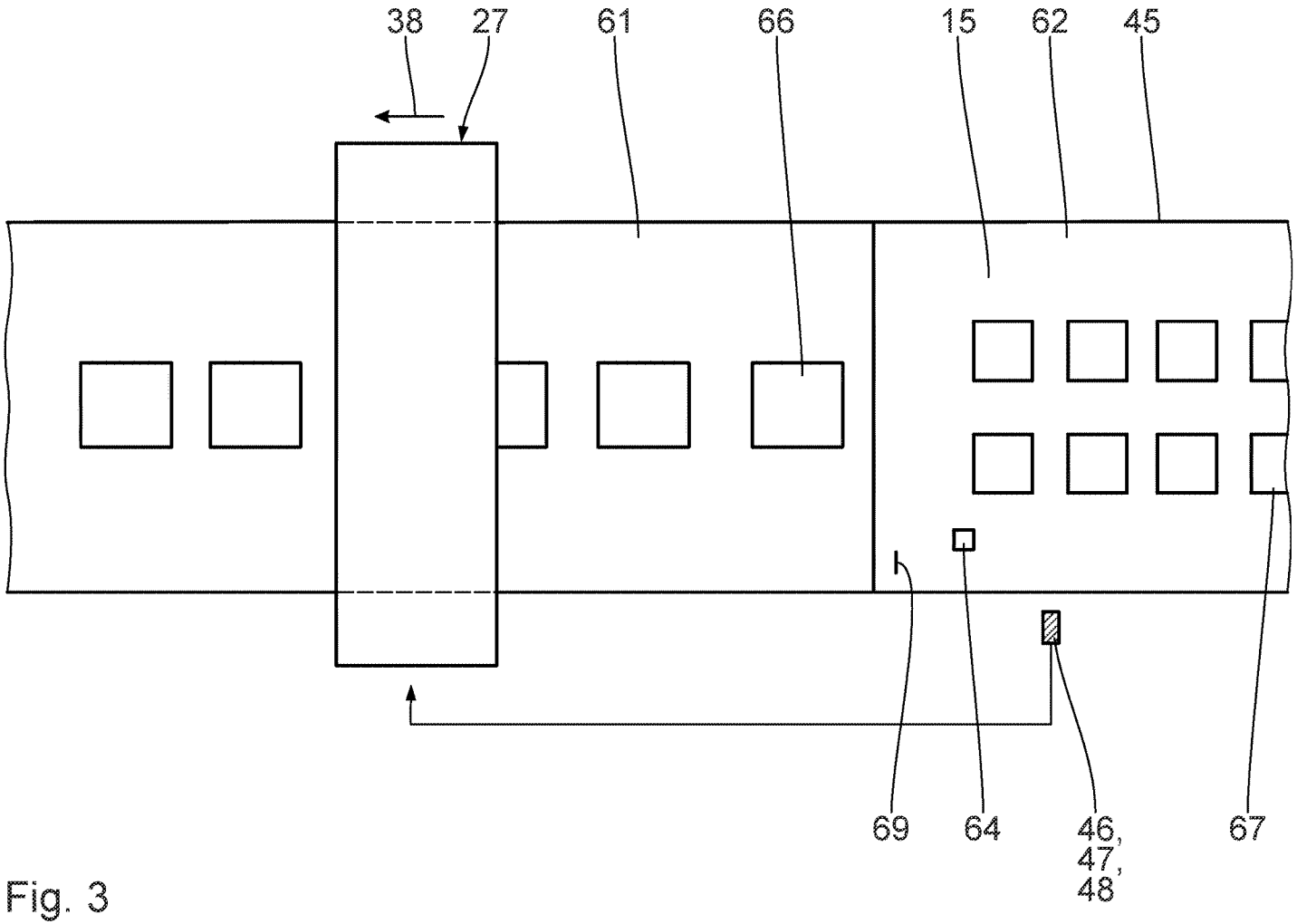
FIG. 3 shows a plan view which illustrates different printing areas of the printed corrugated board web, which have been produced by the corrugated board machine shown in FIG. 1.
Figure 4:
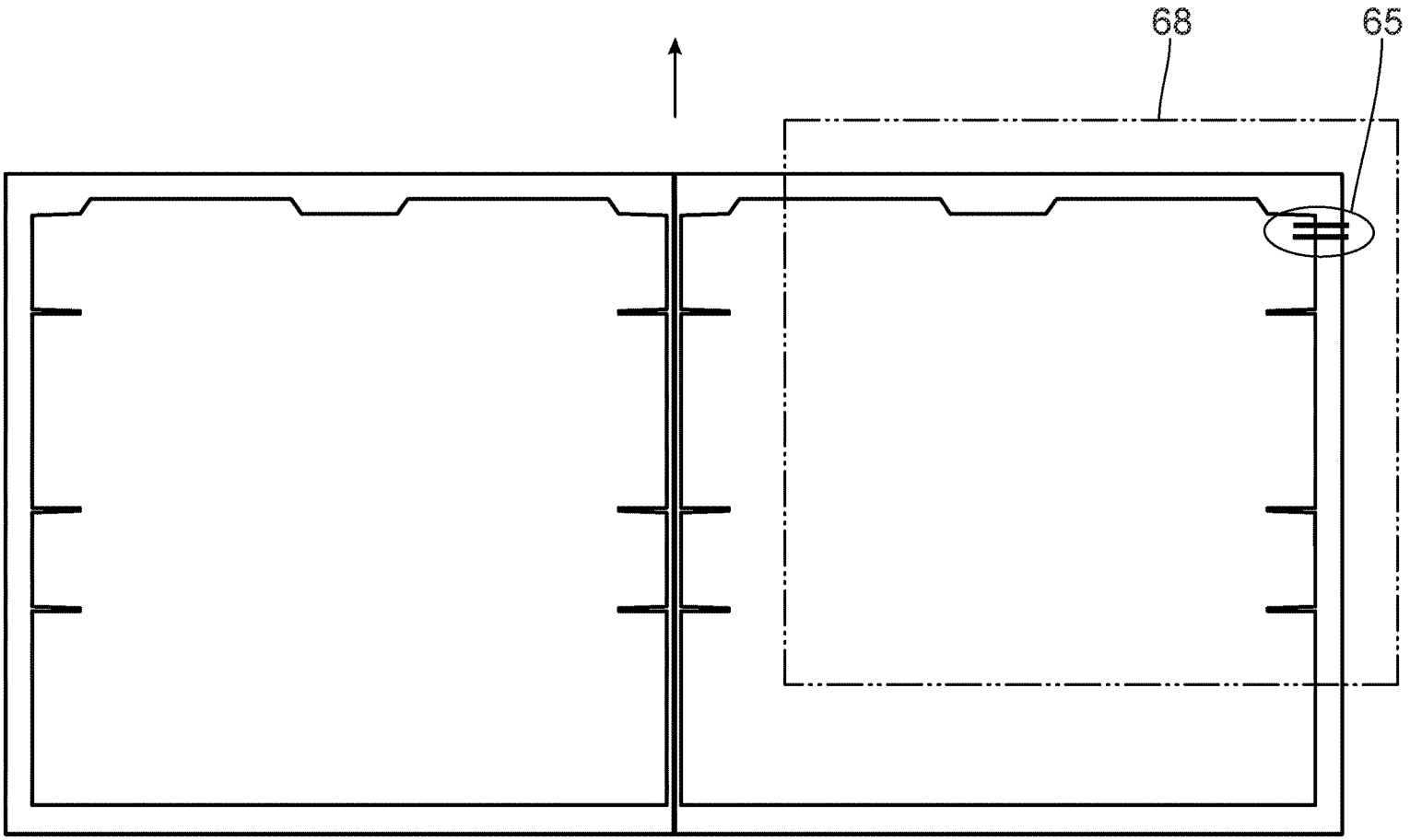
FIG. 4 shows a plan view of two partly corrugated board webs, which have been produced by the corrugated board machine shown in FIG. 1, wherein a detecting area of the detecting arrangement is shown.
Figure 5:
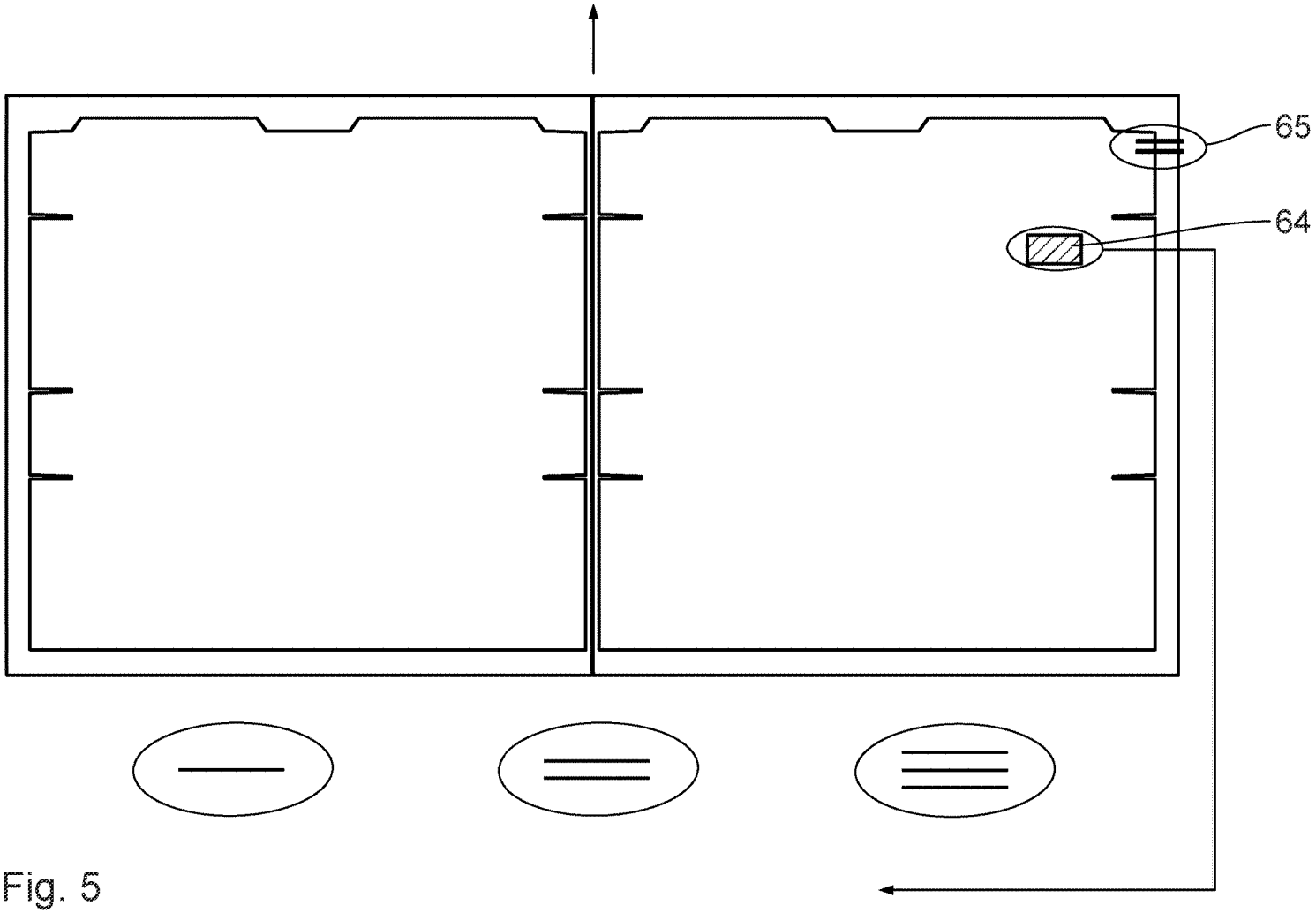
FIG. 5 shows a plan view of two partly corrugated board webs, which comprise different change reference markings and have been produced by means of the corrugated board machine shown in FIG. 1.

As shown in FIG. 3, a first printing area 61 and a second printing area 62 are arranged on the outside 45 of the third material web 15, which second printing area differs from the first printing area 61 and follows the first printing area 61. On the first printing area 61 individual imprints 66 are arranged in precisely one row which extends in conveying direction 38. On the second printing area 62 individual imprints 67 are arranged in precisely two rows, which extend in conveying direction 38 and parallel to one another. The imprints 67 are smaller than the imprints 66. Other printing areas of imprints are possible as an alternative.

Figure 2:
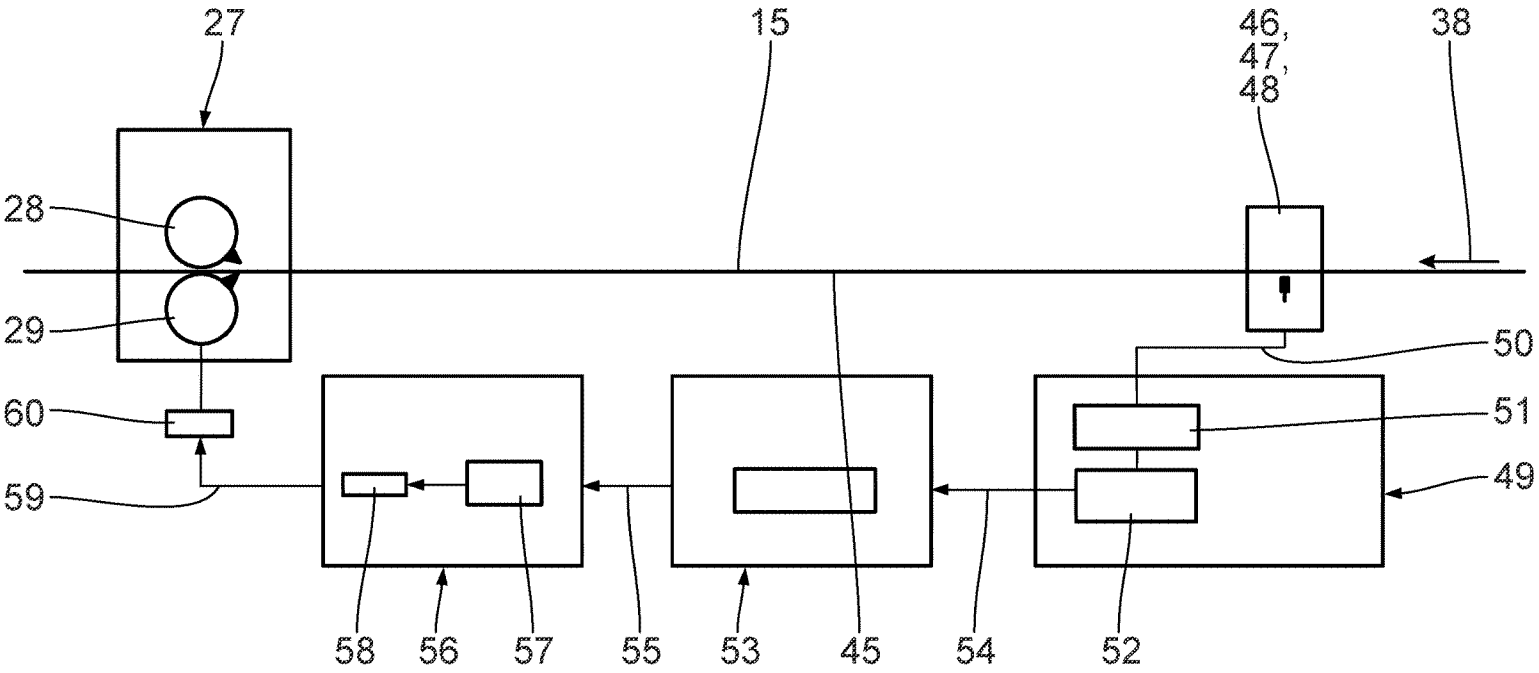
FIG. 2 shows a block diagram which includes the detecting arrangement, the information processing device and the control device as well as the cross-cutting device of the corrugated board machine shown in FIG. 1.

As shown in FIG. 2 the sensor arrangement or the respective sensor 46, 47 and/or 48 is in signal connection with an electronic information processing device 49 via a signal line 50. The sensor arrangement or the respective sensor 46, 47 and/or 48 has/have a sensing area 68, which covers at least mostly the outside 45 of the third material web 15, in particular including its outer edge area.

The information processing device 49 comprises a printing area detection and/or mark calculation unit 51, which receives signals via the signal line 50 from the sensor arrangement or sensor 46, 47 and/or 48, which change with a change of printing area.

The printing area recognition and/or mark calculation unit 51 is in signal connection on the output side with an order change triggering unit 52 which is also part of the information processing device 49.

The order change triggering unit 52 with its output is in signal connection via a signal line 54 with an order change control 53.

The order change control 53 with its output is in signal connection via a signal line 55 with a short cross-cutting device control 56, which is preferably part of the short cross-cutting device 27.

The short cross-cutting device control 56 has a cutting algorithm unit 57, which via the signal line 55 receives signals for the order change corresponding to the order change control 53. Furthermore, the short cross-cutting device control 56 comprises a reference value drive unit 58, which receives corresponding signals from the cutting algorithm unit 57 to the new section of corrugated board web 26.

The reference value drive unit 58 is in signal connection via a signal line 59 with the drive motor 60, which drives the cutting cylinder 28 and/or the counter cylinder 29 during operation.

The printing area recognition and/or mark calculation unit 51 is able by means of the received signals of the sensor 46, 47 and/or 48 to identify the change from the first printing area 61 to the second printing area 62, so that this printing area change information is communicated to the order change triggering unit 52.

The order change triggering unit 52 sends a corresponding order change triggering signal to the order change control 53, which then triggers or initiates an order change cycle.

The order change control 53 then sends corresponding order change signals to the short cross-cutting device control 56, the reference value drive unit 58 of which receives from the cutting algorithm unit 57 corresponding cutting signals for cutting the corrugated board web 26. The reference value drive unit 58 supplies a reference value for the drive motor 60.

The printing area recognition and/or mark calculation unit 51 is able for example to recognise a change of the printing areas 61, 62 directly by image recognition. For this preferably the outside 45 of the third material web 15 is sensed over the whole width.

Alternatively or in addition the printing area recognition and/or mark calculation unit 51 is able to recognise a change reference marking 64, which is arranged on the outside 45 between the first printing area 61 and the second printing area 62.

The printing area recognition and/or mark calculation unit 52 is able alternatively or in addition to recognise a registration mark 65 arranged on the edge of the third material web 15, which stands for an order change. The change reference marking 64 is for example an RFID transponder, a change reference imprint or the like.

It is an advantage, if the sensor arrangement is activated when the corresponding registration mark 65 is sensed. The registration mark 65 can be formed by one or more bars.

The information processing device 49, the order change control 53 and the short cross-cutting device control 56 can be part of a common processor or separate processors. The latter can also run in a program. This should be considered optional.

The signal can be a hardware signal, a fieldbus signal or a signal in the control or circuit.

The signal lines 50, 54, 55, 59 can alternatively be designed to be wireless.

According to an alternative embodiment a corrugated board machine produces corrugated board with more than three webs arranged above one another. The order change cutting device is activated according to the previous embodiment.

In addition, the sensor arrangement is able to recognise, at least one remaining marking 69 which is arranged on the outside 45 of the third material web 15 and supplies remaining information to the third material web 15 or the respective order.

The information processing device 49 controls in the case of a forthcoming change in quality the third unrolling device 16 for starting the next order. For this the information processing device 49 is in signal connection with the third unrolling device 16 which is arranged upstream of the sensor arrangement. The at least one remaining marking 69 can be provided in any form and/or placed at random on the outside 45.

What is claimed is:

1. A corrugated board machine for producing corrugated board, the corrugated board machine comprising:

a detecting arrangement for detecting at least one printed web of a corrugated board web;

an order change cutting device arranged downstream of the detecting arrangement;

an information processing device, the information processing device being in signal connection with the detecting arrangement; and a control device, the control device being in signal connection with the information processing device and the control device being in signal connection with the order change cutting device, wherein the control device as a function of a change recognized by the information processing device of a first printing area printed onto the web of the corrugated board web to a second printing area printed onto the web of the corrugated board web activates the order change cutting device for bringing about an order change on the corrugated board web, wherein the detecting arrangement is also able to detect at least one remaining running marking arranged on the web, wherein the information processing device on the basis of the at least one detected remaining running marking controls an unrolling device for delivering the web at a start of the next order.

2. A corrugated board machine according to claim 1, wherein the detecting arrangement is an optically operating detecting arrangement.

3. A corrugated board machine according to claim 1, wherein the information processing device identifies the change of the first printing area to the second printing area by at least one of image recognition and image comparison.

4. A corrugated board machine according to claim 1, wherein the information processing device identifies the change from the first printing area to the second printing area by at least one change reference marking on the web of the corrugated board web or by an image comparison without change reference marking.

5. A corrugated board machine according to claim 4, wherein the change reference marking is arranged in any position on the web.

6. A corrugated board machine according to claim 4, wherein the change reference marking is arranged laterally on the web.

7. A corrugated board machine according to claim 4, wherein the change reference marking is arranged centrally on the web.

8. A corrugated board machine according to claim 4, wherein the change reference marking is formed by at least one geometric figure.

9. A corrugated board machine according to claim 1, wherein the detecting arrangement for detecting the web comprises a detecting unit, which is arranged upstream of a gluing station for gluing and connecting a corrugated board web laminated on one side to at least one additional material web.

10. A corrugated board machine according to claim 1, wherein the detecting arrangement for detecting the web comprises a detecting unit, which is arranged downstream of a gluing station for gluing and connecting a corrugated board web laminated on one side to at least one additional material web.

11. A corrugated board machine according to claim 1, wherein the detecting arrangement for detecting the web comprises a detecting unit which is arranged downstream of a heating and pressing device.

12. A corrugated board machine according to claim 1, wherein the order change cutting device comprises at least one cross-cutting device for at least partly cross-cutting the corrugated board web transversely to a conveying direction of the corrugated board web to bring about the order change.

13. A corrugated board machine according to claim 12, wherein the control device operates the at least one cross-cutting device such that the the at leant one cross-cutting device cuts into a change area between the printing areas.

14. A corrugated board machine according to claim 1, wherein the order change cutting device comprises at least one longitudinal cutting device adjustable perpendicular to a conveying direction of the corrugated board web for longitudinally cutting the corrugated board web in a conveying direction of the corrupted board web as a function of a respective order.

15. A corrugated board machine according to claim 1, wherein the unrolling device is a splicing device.

16. A corrugated board machine according to claim 1, wherein the at least one remaining running marking comprises data, the data comprising one of a remaining length of printed web of the corrugated board web of a previously printed web of corrugated board web and information about a remaining length of a web of corrugated board of a current order printed in the corrugated board machine.

17. A corrugated board machine for producing corrugated board, the corrugated board machine comprising:

a detecting arrangement configured to detect at least one printed web of a corrugated board web and to detect at least one remaining running marking arranged on the corrugated board web;

an order change cutting device arranged downstream of the detecting arrangement;

an information processing device connected to the detecting arrangement, the information processing device being configured to detect a change of a first printing area printed onto the web of the corrugated board web to a second printing area printed onto the web of the corrugated board web, the information processing device being further configured to control an unrolling device based on the at least one detected remaining running marking for delivering the web at a start of the next order; and a control device connected to the information processing device and the control device and the order change cutting device, wherein the control device is configured to activate the order change cutting device based on the change of the first printing area to the second printing area detected by the information processing device for bringing about an order change on the corrugated board web.

18. A corrugated board machine according to claim 17, wherein the at least one remaining running marking comprises data, the data comprising at one of a remaining length of printed web of the corrugated board web of a previously printed web of corrugated board web and information about a remaining length of a web of corrugated board of a current order printed in the corrugated board machine.

19. A corrupted board machine for producing corrugated board, the corrugated board machine comprising:

a detecting arrangement configured to detect at least one printed web of a corrugated board web and to detect at least one remaining running marking arranged on the corrugated board web;

an order change cutting device arranged downstream of the detecting arrangement;

an information processing device connected to the detecting arrangement, the information processing device receiving detecting arrangement input from the detecting arrangement, the detecting arrangement input comprising detecting arrangement data corresponding to the at least one remaining running marking, the information processing device being configured to detect a change of a first printing area printed onto the web of the corrugated board web to a second printing area printed onto the web of the corrugated board web based on the detecting arrangement data, the information processing device being further configured to control an unrolling device based on the detecting arrangement data for delivering the web at a start of the next order; and a control device connected to the information processing device and the control device and the order change cutting device, the control device receiving information processing device input from the information processing device, the information processing device input comprising information processing device data corresponding to the change of the first printing area printed onto the web of the corrugated board web to the second printing area printed onto the web of the corrugated board web, wherein the control device is configured to activate the order change cutting device based on the information processing device data for bringing about an order change on the corrugated board web.

20. A corrugated board machine according to claim 19, wherein the at least one remaining running marking comprises running marking data, the running marking data comprising at one of a remaining length of printed web of the corrugated board web of a previously printed web of corrugated board web and information about a remaining length of a web of corrugated board of a current order printed in the corrugated board machine.

* * * * *